US006012993A

United States Patent [19]

Guerriero

[11] Patent Number: 6,012,993

[45] Date of Patent: Jan. 11, 2000

[54] ATHLETIC TRAINING HARNESS

[76] Inventor: Gary P. Guerriero, 511 E. 80th St., Apt. 5A, New York, N.Y. 10028

[21] Appl. No.: 08/890,204

[22] Filed: Jul. 9, 1997

[51] Int. Cl.[7] ..... A63B 69/40

[52] U.S. Cl. ..... 473/424; 182/3

[58] Field of Search ..... 473/424, 206, 473/207, 213, 214, 215, 216, 450, 518, 519, 105; 182/3, 7; 482/69, 3

[56] References Cited

U.S. PATENT DOCUMENTS

| | | | |
|---|---|---|---|
| 1,967,767 | 8/1934 | Diez | 182/3 |
| 2,195,299 | 3/1940 | Frankel | 182/3 |
| 5,048,836 | 9/1991 | Bellagamba . | |
| 5,080,191 | 1/1992 | Sanchez | 182/3 |
| 5,131,490 | 7/1992 | Bell | 182/7 |
| 5,360,082 | 11/1994 | Bell | 182/3 |
| 5,403,253 | 4/1995 | Gaylord | 482/43 |
| 5,498,219 | 3/1996 | Soufi | 482/69 |

*Primary Examiner*—Theatrice Brown
*Attorney, Agent, or Firm*—Watson Cole Grindle Watson, P.L.L.C.

[57] ABSTRACT

A waist belt has opposite free ends which can be buckled together. A pair of fabric loops are disposed at the free ends and define holes for attachment to a tether. A pair of adjustable thigh straps are supported below the belt. Seven connectors are supported on the belt at locations along the belt adjacent to strategic musculo-skeletal points of the pelvis. The connectors are disposed adjacent the left and right anterior superior iliac spines, the left and right iliac crests, the left and right posterior superior iliac spines and the sacrum of a user when the harness is in use.

18 Claims, 14 Drawing Sheets

ATHLETIC TRAINING HARNESS

BACKGROUND OF THE INVENTION

The present invention relates to an athletic training harness, and more particularly to a harness which is adapted to increase the power and speed of various motions required in a variety of sports activities.

Various training devices have been provided in the prior art for assisting users in improving their skills in different sports. Many of these devices are specially designed for use with a particular sport. For example, U.S. Pat. No. 5,048,836 discloses a swing practice apparatus for use in performing a golf swing. Such devices are satisfactory for such limited uses, but it is desirable to provide a training device which has broader application to a number of different sports.

Such training devices may be adapted to increase the power of an athlete by providing a force which resists a particular athletic movement, or they may be adapted to increase the speed of movement of an athlete by providing a force which assists in the desired movement. In devices of this type, it is important that the force is applied to the athlete at strategic musculo-skeletal points on the body of the athlete. Therefore, it is an objective of the invention to provide a harness which is useful in many different sports and which ensures that the force applied to the harness is applied adjacent such strategic points.

SUMMARY OF THE INVENTION

The invention provides an athletic training harness which comprises both a waist harness and a shoulder harness. The waist harness may be used by itself in most applications, or the waist harness may be used in combination with the shoulder harness in certain specific sports. The invention may be used in training athletes in may different sports, such as baseball, golf, soccer, tennis, football, basketball, running and jumping.

A waist harness has a waist portion which fits around the waist of a user and includes opposite free ends which may be secured to one another. A pair attaching loops are disposed at the opposite ends of the waist portion and have holes therein for connecting the loops to a tether. This arrangement is useful in training a runner, and a force may be applied to the tether in the direction of movement of the runner to assist the runner and cause him to run faster.

The waist harness also has adjustable straps which fit around the thighs of a user and which are supported below and connected to the waist portion. The waist portion supports seven connectors at spaced points along the waist portion, each of these connectors being adapted to be connected to a tether so that a force can be applied to the tether and transmitted to the waist portion at a point adjacent a strategic musculo-skeletal point of the pelvis of a user.

When the harness is in use, the connectors are disposed at locations along the waist portion of the harness adjacent the right and left anterior superior iliac spines, the right and left iliac crests, the right and left posterior iliac spines and the sacrum of a user. These connectors are adapted to be connected to tethers which can be held by trainers or which can be connected to fixed members.

In addition, a shoulder harness may be provided for use in certain sports such as basketball and running. The shoulder harness is provided with depending connector members to connect the shoulder harness to the waist harness. Whereas the waist harness may be used separately, the shoulder harness is always connected to the waist harness when the shoulder harness is in use. The depending connector members of the shoulder harness are adapted to be connected to the connectors of the waist portion adjacent to the anterior superior iliac spines and the posterior superior iliac spines of a user when the harness is in use.

DESCRIPTION OF THE PREFERRED EMBODIMENT

Figure 1:
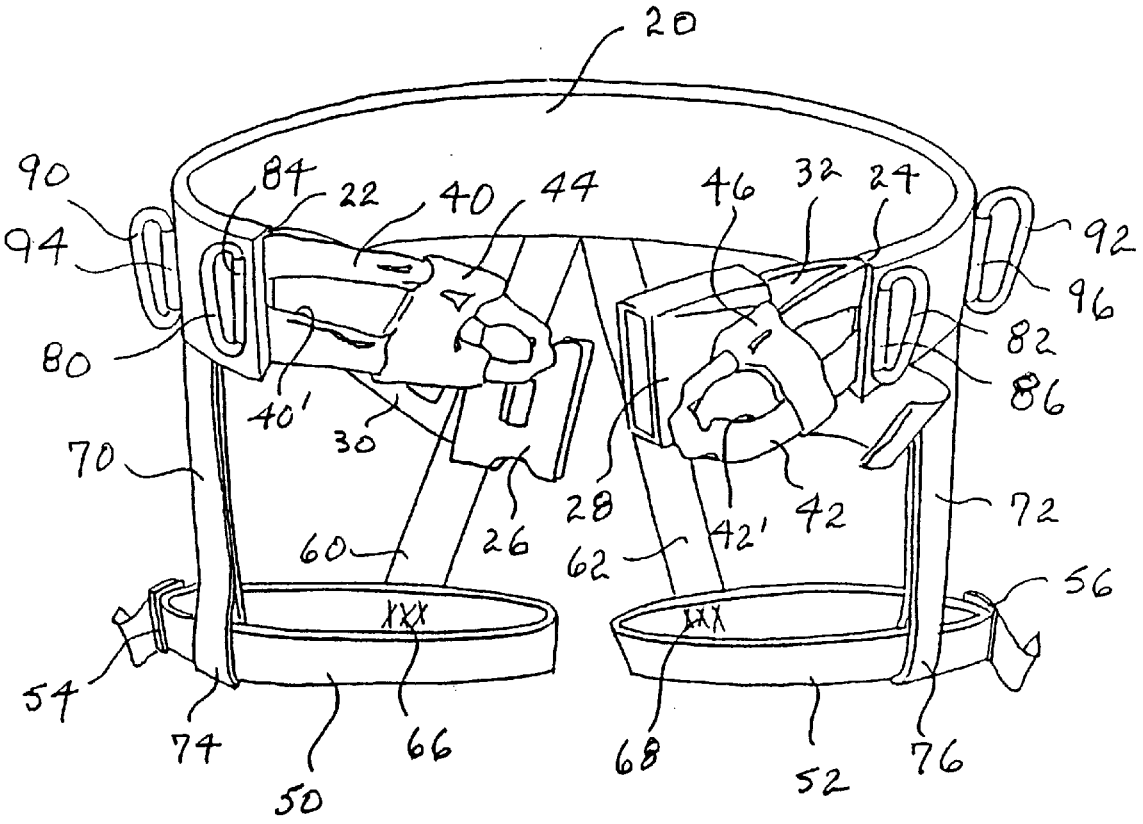
FIG. 1 is a front perspective view of the waist harness.
Figure 2:
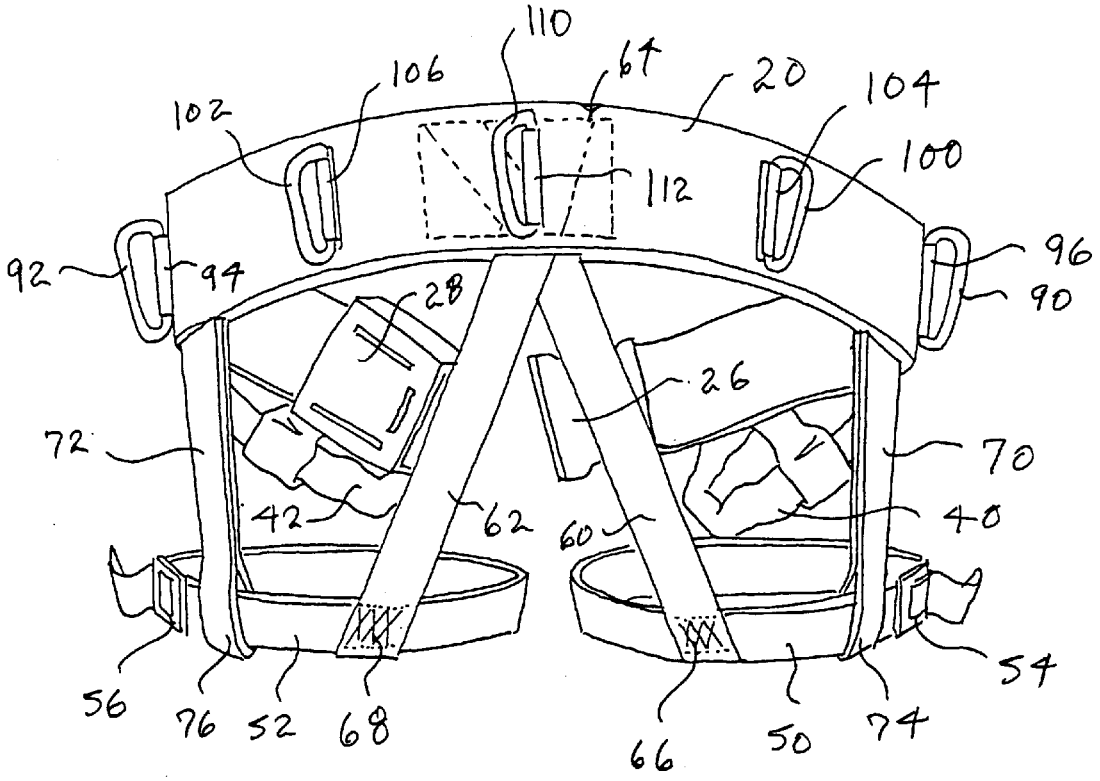
FIG. 2 is a rear perspective view of the waist harness shown in FIG. 1.

Referring now to the drawings wherein like reference characters designate corresponding parts throughout the several views, there is shown in FIGS. 1 and 2 a waist harness including a waist portion or belt 20 formed of a non-stretchable material such as a nylon padded composite which is adapted to fit around the waist of a user. The waist portion has opposite free ends 22 and 24 which are adapted to secured to one another by suitable buckling mechanism 26, 28 similar to an aircraft seat belt buckle arrangement, members 26 and 28 being connected by straps 30, 32 to the free ends 22 and 24 respectively.

A pair of attaching means 40 and 42 are connected to the waist portion at the ends 22 and 24, each of the attaching means comprising a loop of flexible fabric material such as nylon defining openings 40' and 42' formed through the attaching means. Pieces of material 44 and 46 similar to the material of attaching means 40 and 42 are connected as by stitching between spaced portions of the loops to reinforce the attaching means. These attaching means are adapted to be connected to a tether when a user is running in a particular direction so that a force can be applied to the harness through the tether in the direction in which the user is running to increase the speed of the user. The tether can simply pass through the openings, or a suitable rigid link can be connected between the openings and the tether in turn can be connected to the link.

A pair of thigh portions 50 and 52 comprise straps which are adjustable by means of buckles 54 and 56 respectively in a well-known manner. The thigh portions are, of course adapted to fit around the thighs of a user. The thigh portions are supported by support straps 60 and 62 which are fixed to the waist portion and the associated thigh portions by stitching 64 at the waist portion and stitching 66 and 68 at thigh portions 50 and 52 respectively. Support straps 70 and 72 are fixed as by stitching at their upper ends to waist portion 20, and the lower ends 74 and 76 thereof form loops which slidably receive thigh portions 50 and 52 respectively. This sliding relationship permits the thigh straps to be adjusted to accommodate users of different size. The thigh portions and the support straps may all be formed of a suitable flexible fabric material such as nylon.

Figure 3:
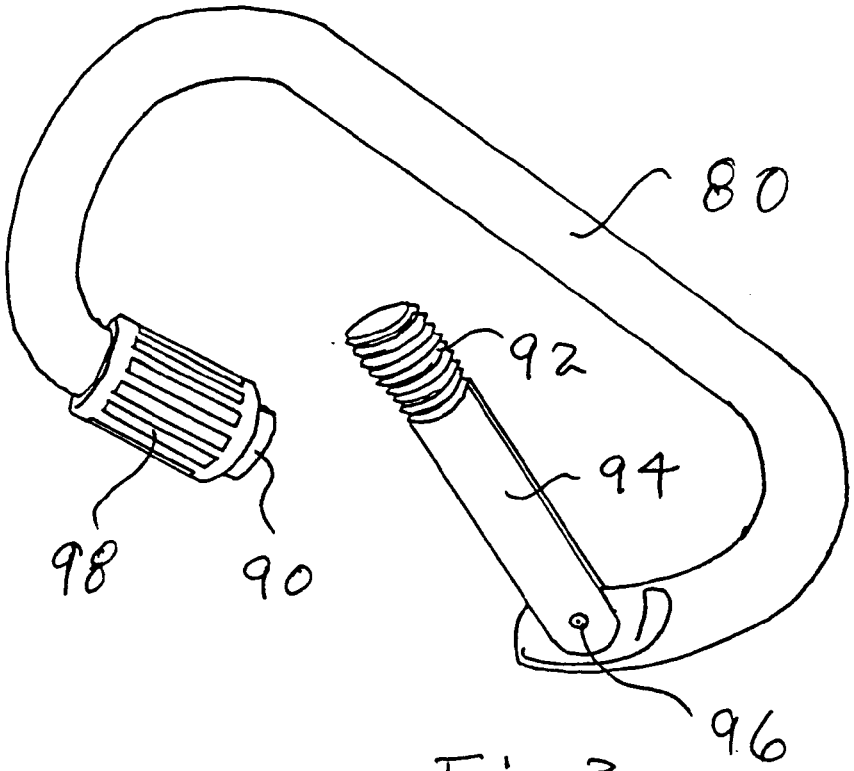
FIG. 3 is a perspective view of a connector in open position.
Figure 3A:
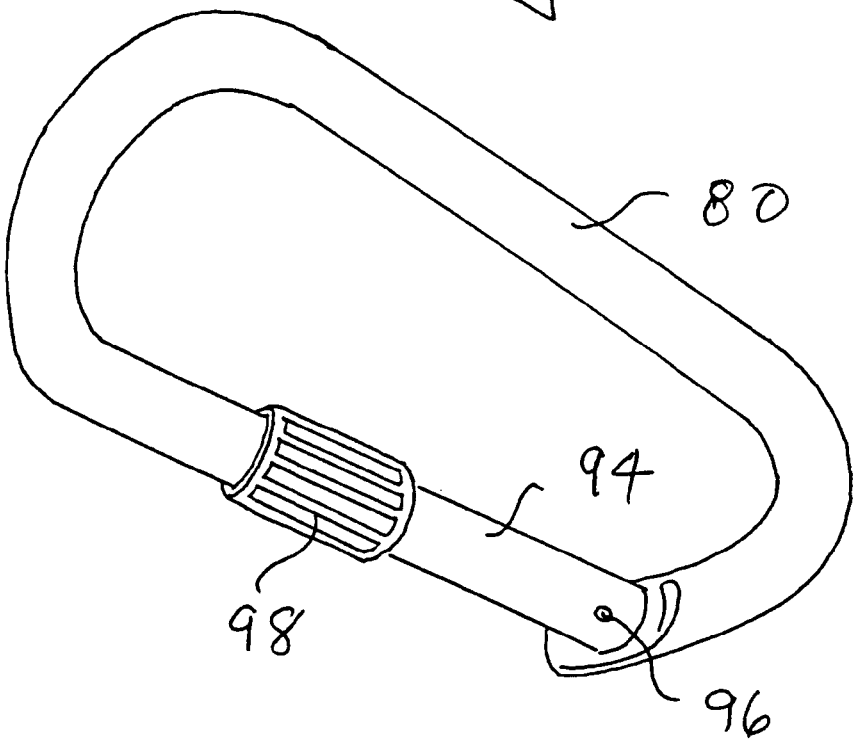
FIG. 3*a* is a view of the connector in closed position.

A pair of connectors 80 and 82 are supported on the waist portion by fabric tubular flaps 84 and 86 respectively which are connected as by stitching to the waist portion. Referring to FIG. 3, the construction of connector 80 is shown. The connector includes a first end 90 and an opposite threaded end 92 which is disposed at the end of a member 94 pivoted at 96 to the rest of the connector. An internally threaded cylinder 98 is slidably mounted on end 90 and is adapted to be threaded onto threaded end 92 as shown in FIG. 3*a* to maintain the connector in position. It is apparent that in the open position shown in FIG. 3, the connector can be inserted through a tubular flap on the waist portion, and the connector can then be closed as shown in FIG. 3*a* so that the connector cannot escape from the associated flap. All of the connectors may be of the same construction, and each connector is supported by a tubular flap.

Connectors 80 and 82 are disposed at locations along the waist portion 20 adjacent the right and left anterior superior iliac spines of a user when the harness is in use. A further pair of connectors 90 and 92 are supported on the waist portion by flaps 94 and 96 respectively which are connected as by stitching to the waist portion. Connectors 90 and 92 are disposed at locations along the waist portion 20 adjacent the right and left iliac crests of a user when the harness is in use. Still another pair of connectors 100 and 102 are supported on the waist portion by flaps 104 and 106 respectively which are connected as by stitching to the waist portion. Connectors 100 and 102 are supported at locations along the waist portion 20 adjacent the right and left posterior superior iliac spines of a user when the harness is in use. An additional connector 110 is supported by a flap 112 which is connected as by stitching to the waist portion. Connector 110 is disposed on the waist portion 20 adjacent the sacrum of a user when the harness is in use.

Figure 4:
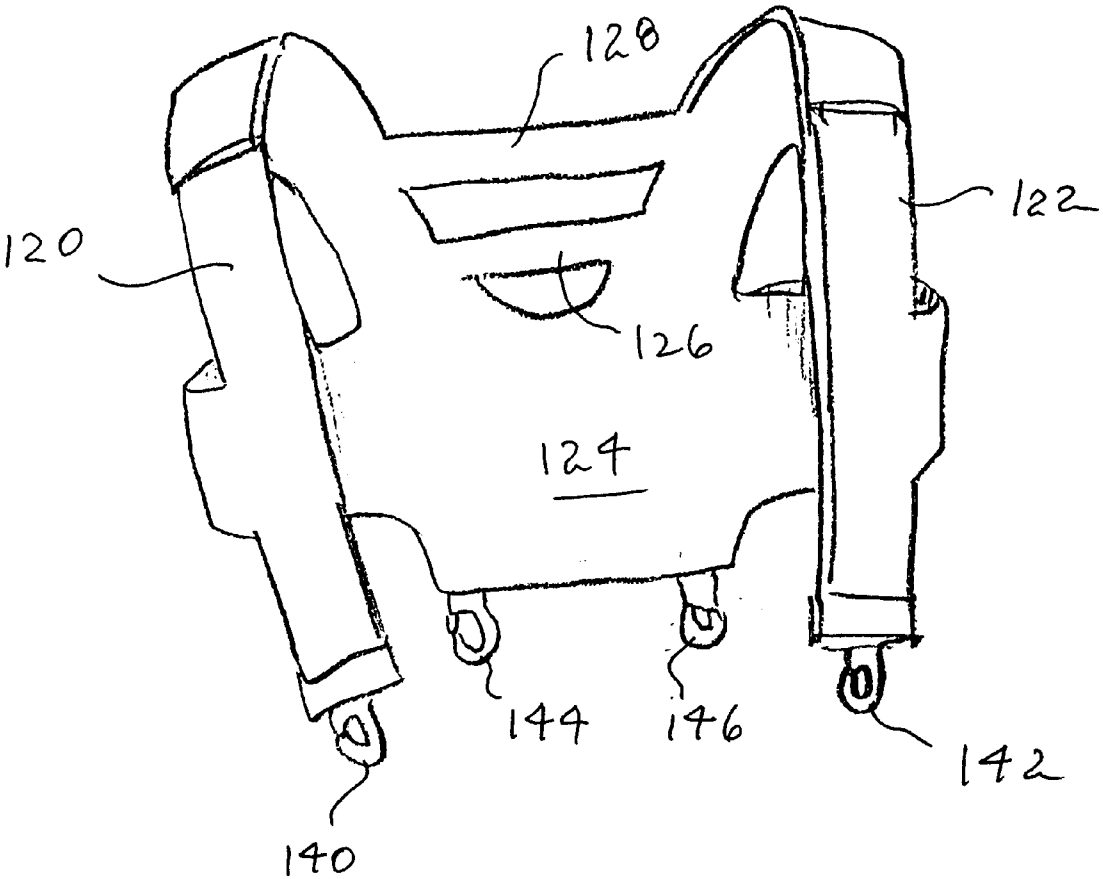
FIG. 4 is a front perspective view of the shoulder harness.
Figure 5:
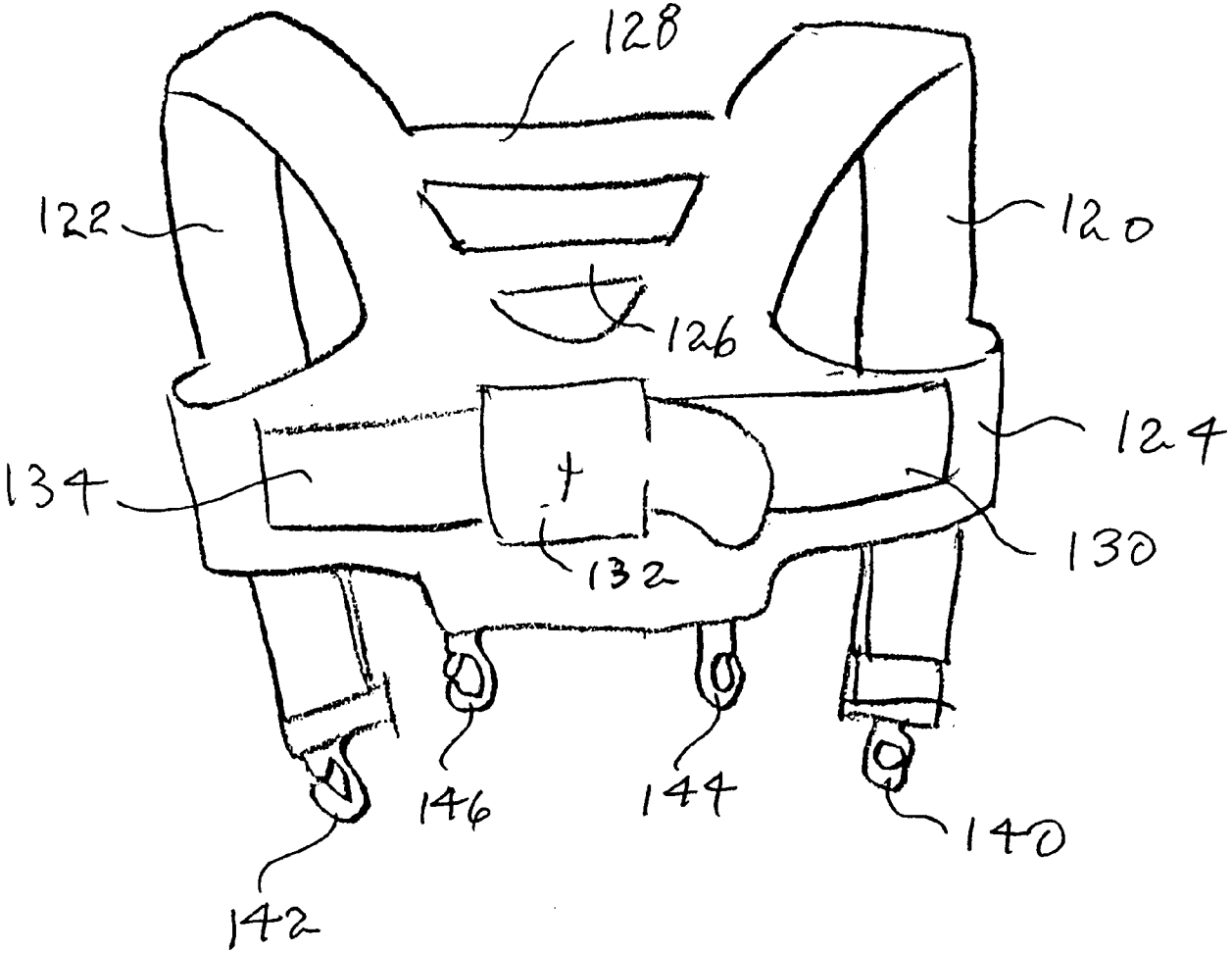
FIG. 5 is a rear perspective view of the shoulder harness.

Referring to FIGS. 4 and 5, a shoulder harness includes a pair of shoulder straps 120 and 122 which are adapted to fit over the shoulders of a user. The shoulder straps may be padded for comfort, and have a torso strap 124 connected therebetween. A pair of auxiliary straps 126 and 128 may also be connected between the shoulder straps. On the back of torso strap 124, a strap 130 is connected as by stitching to the torso strap, strap 130 having a buckle 132 connected to the free end thereof. A further strap 134 is connected as by stitching to the torso strap, the free end of strap 134 passing through the buckle 132 to permit the shoulder harness to be tightened about the torso of a user.

A pair of depending connector members 140 and 142 are connected to the lower ends of straps 120 and 122 respectively. Members 140 and 142 may comprise conventional spring clips. A further pair of similar depending connector members 144 and 146 are connected to the lower edge portion of torso strap 124. When the shoulder harness is in use in combination with the waist harness, connector members 140 and 142 are connected to connectors 80 and 82 respectively of the waist harness, and connector members 144 and 146 are connected to connectors 100 and 102 respectively.

Figure 6:
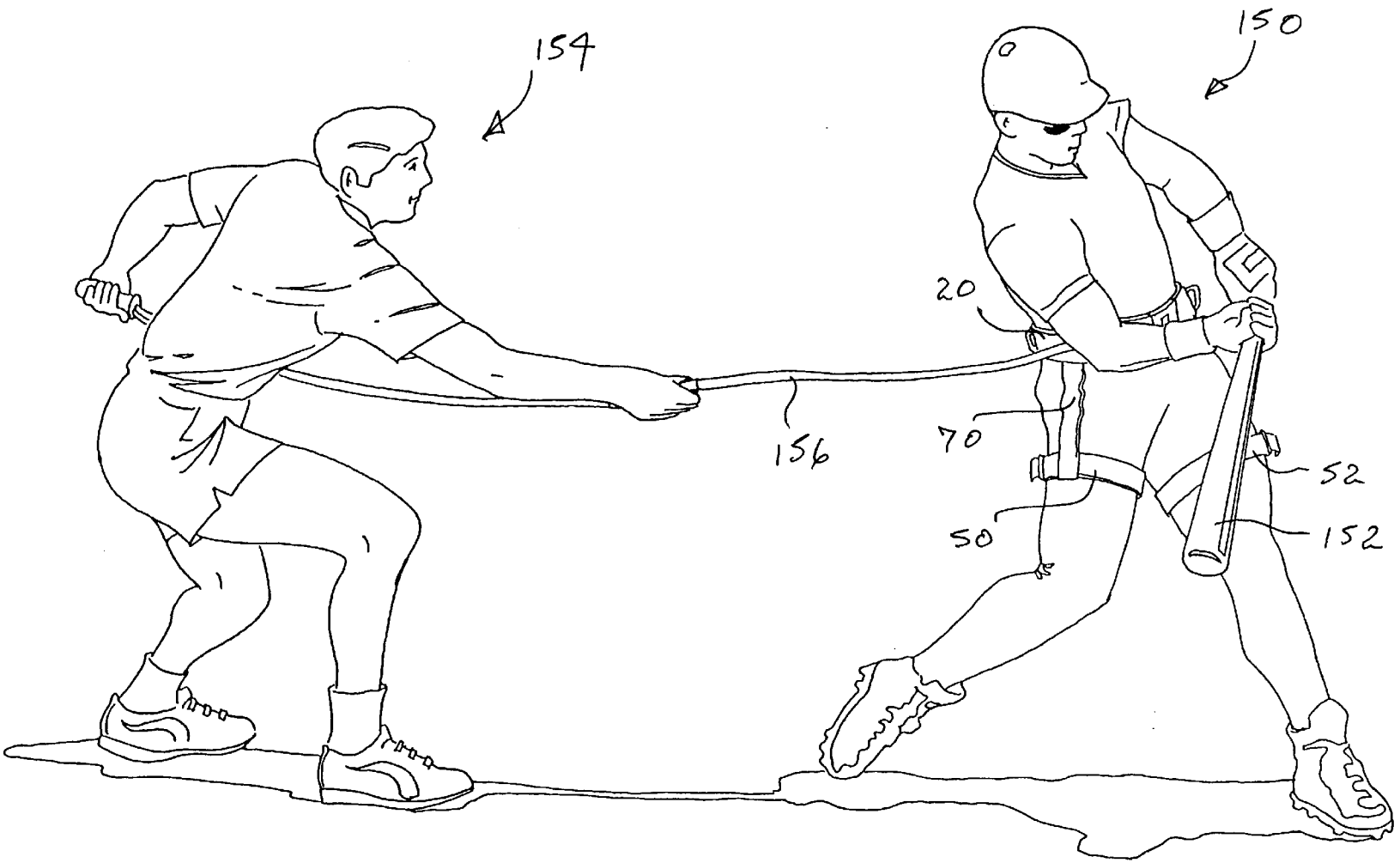
FIG. 6 is a view showing the harness connected to a tether as used in training a user making a baseball swing.

Referring to FIG. 6, the manner of using the invention to improve the skills of a baseball player is illustrated. A player 150 is shown as swinging a bat 152 in the normal manner. The waist harness is shown in operative position with the waist portion fitting about the waist of the player and the thigh straps fitting about his thighs. A trainer 154 is holding a tether 156 which is connected to the connector 80 (not visible) on the waist portion of the harness. The trainer is pulling on the tether to apply a force to the harness which resists the forward swing of the player, thereby impeding the swing. The player must overcome the resistance applied by the tether, thereby increasing the power of the player in making such a swing.

The harness can also be employed for increasing the speed of the swing. In such a case, the trainer stands in front of the player instead of behind the player, and as the player swings, the trainer pulls forward on the tether so as to assist the player in making the swing, thereby increasing the speed of the swing. Repeated swinging at this increased speed improves the player's ability to swing unassisted at the increased rate of speed.

Figure 7:
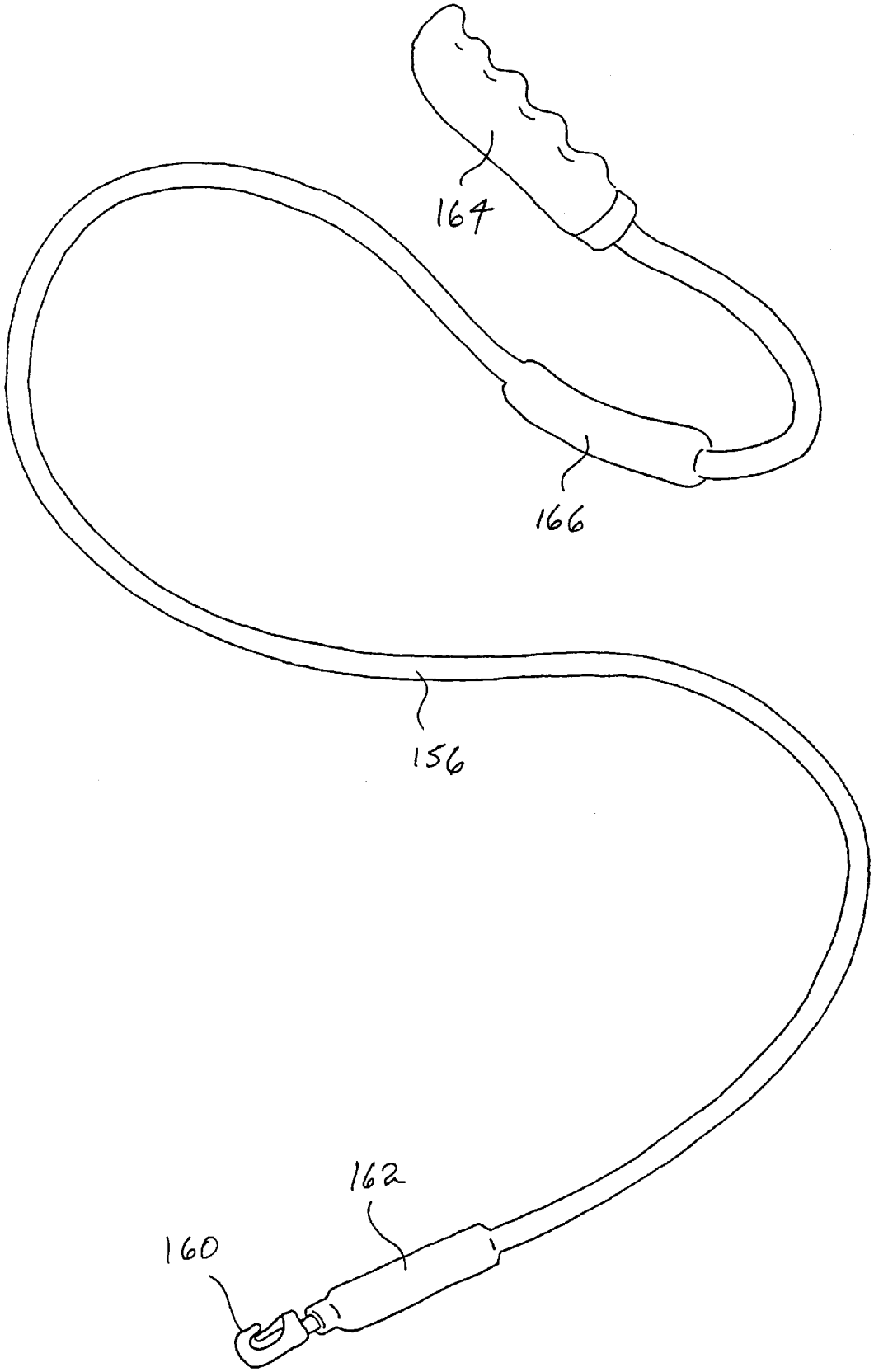
FIG. 7 is a perspective view of the tether shown in FIG. 6.

Referring to FIG. 7, the tether 156 shown in FIG. 6 is illustrated in detail. The tether may be formed of suitable flexible material such as bungee cord, or it may be formed of a non-stretchable material, if desired. The tether may be of different gauges when flexible material is used so as to vary the amount of force applied to the harness. The tether is provided at one end with a spring clip 160 which is connected to a reinforced end portion 162 of the tether. This spring clip is adapted to be connected to connector 80 of the harness. The opposite end of the tether is connected to a hand grip 164 having indentations for receiving the fingers of a trainer. An enlarged gripping portion 166 is also provided for gripping with the other hand of the trainer as shown in FIG. 6.

It is apparent that while the tether is shown as connected to the right connector 80 of the waist harness when the batter is right-handed, the tether can be connected to the the left connector 82 when the batter is left-handed.

Figure 8:
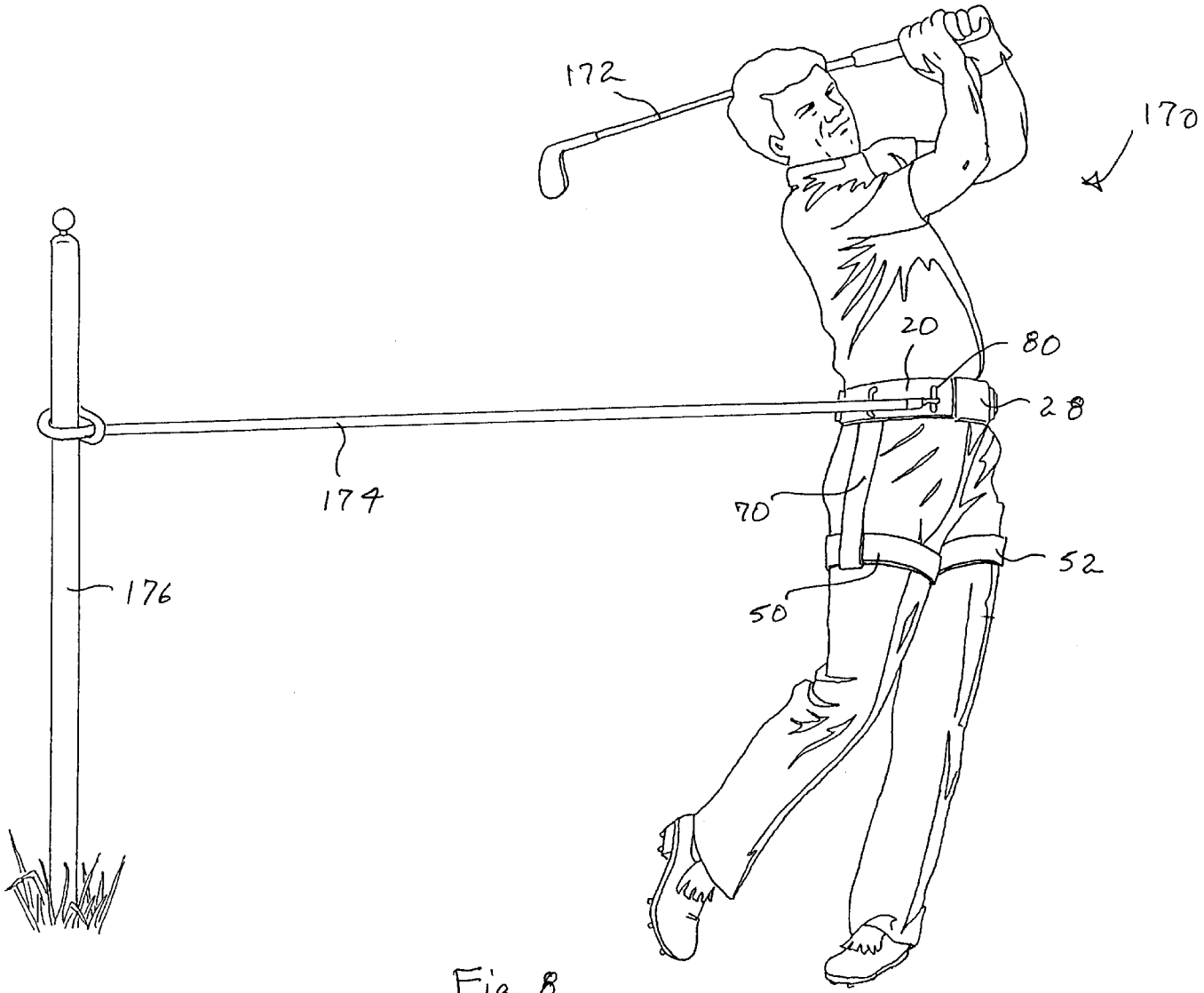
FIG. 8 is a view showing the harness as used in training a user making a golf swing.

Referring to FIG. 8, the invention is shown as employed for training a golfer to increase the power of the golf swing. A golfer 170 is shown swinging a golf club 172. A tether 174 is shown as being connected to connector 80 of the waist harness, the opposite end of the tether being looped around and fixed to an upstanding post 176 which is embedded in the ground. It is apparent that the tether will resist forward turning movement of the golfer as he makes his normal golf swing.

Figure 9:
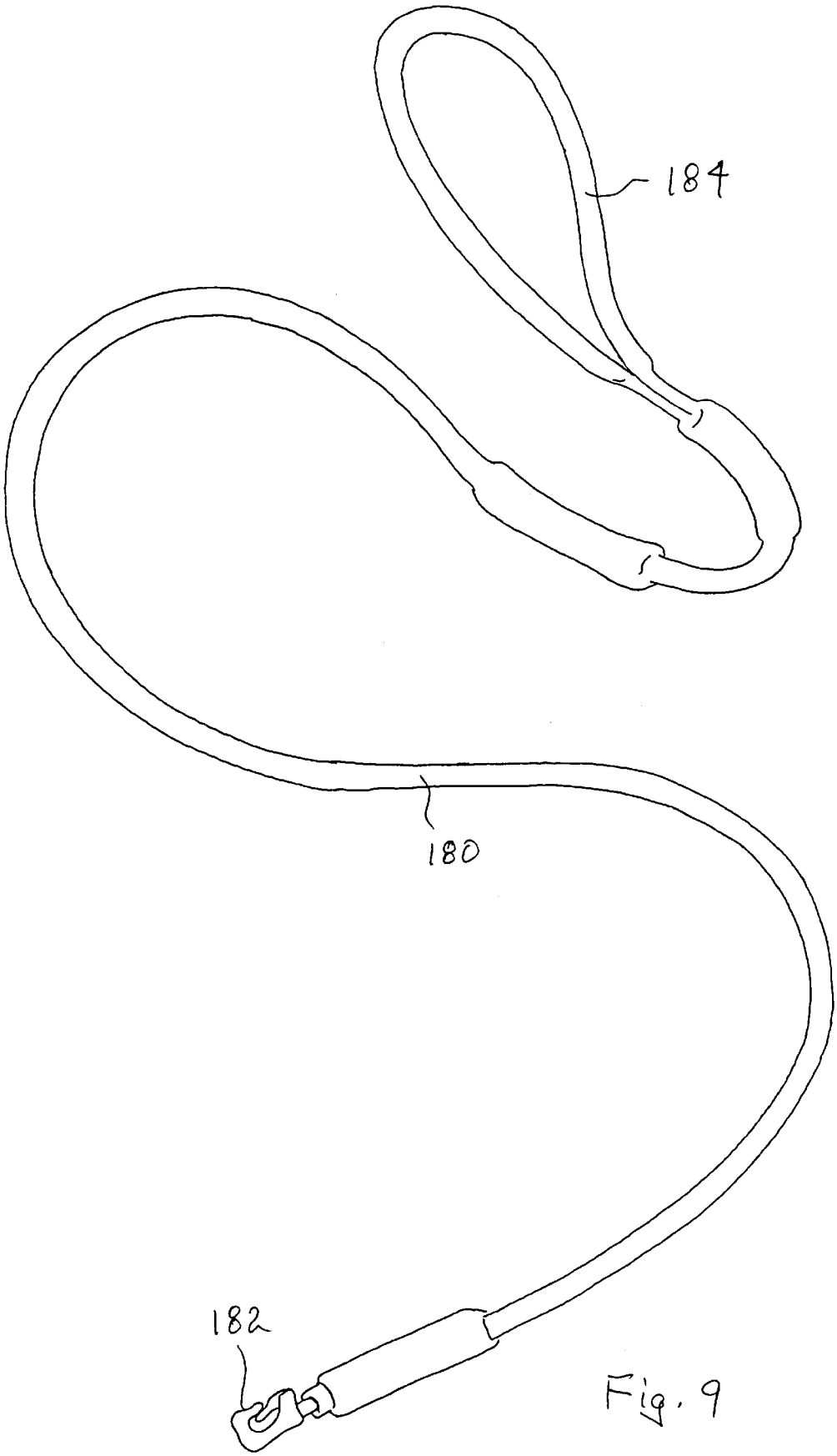
FIG. 9 is a perspective view of the tether shown in FIG. 8.

Referring to FIG. 9, a tether of the type which can be employed in the relationship shown in FIG. 8 is illustrated. Tether 180 has a spring clip 182 connected to one end thereof, and the opposite end of the tether is formed as a loop 184. The lower end of the tether as seen in FIG. 9 can be threaded through loop 184 to secure the tether to a post as shown in FIG. 8 with the spring clip 182 connected to connector 80 on the waist harness.

Figure 10:
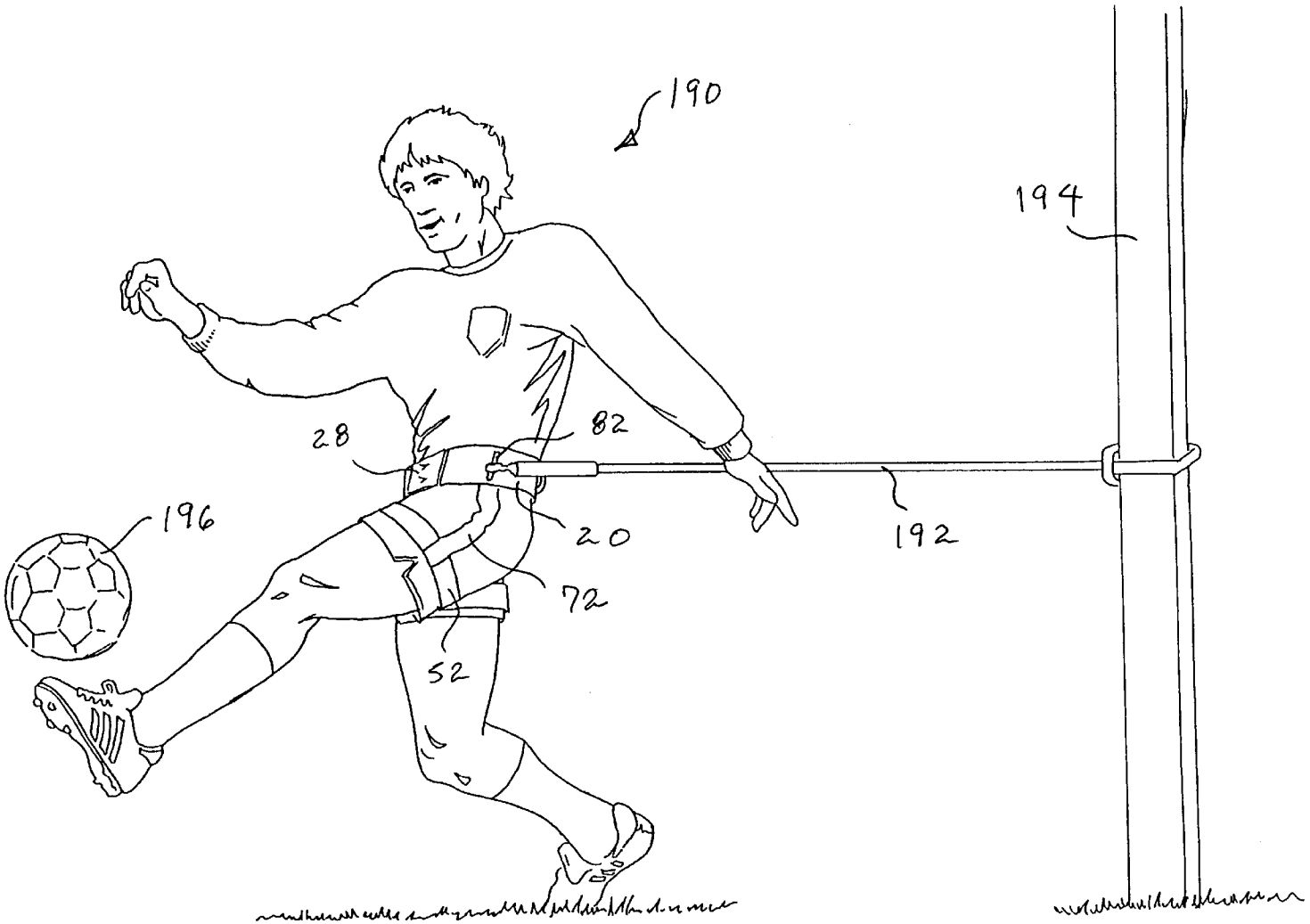
FIG. 10 is a view showing the harness as used in training a user making a soccer kick.

Referring to FIG. 10 a soccer player 190 is shown utilizing the invention waist harness which is connected to a tether 192 similar to that shown in FIG. 9. The tether is connected at one end to a post 194 embedded in the ground, the opposite end of the tether being connected to connector 82 of the waist harness since the soccer player is kicking a soccer ball 196 with his left foot. The tether applies resistance to the kicking motion, thereby increasing the power of the player in overcoming this resistance.

Figure 11:
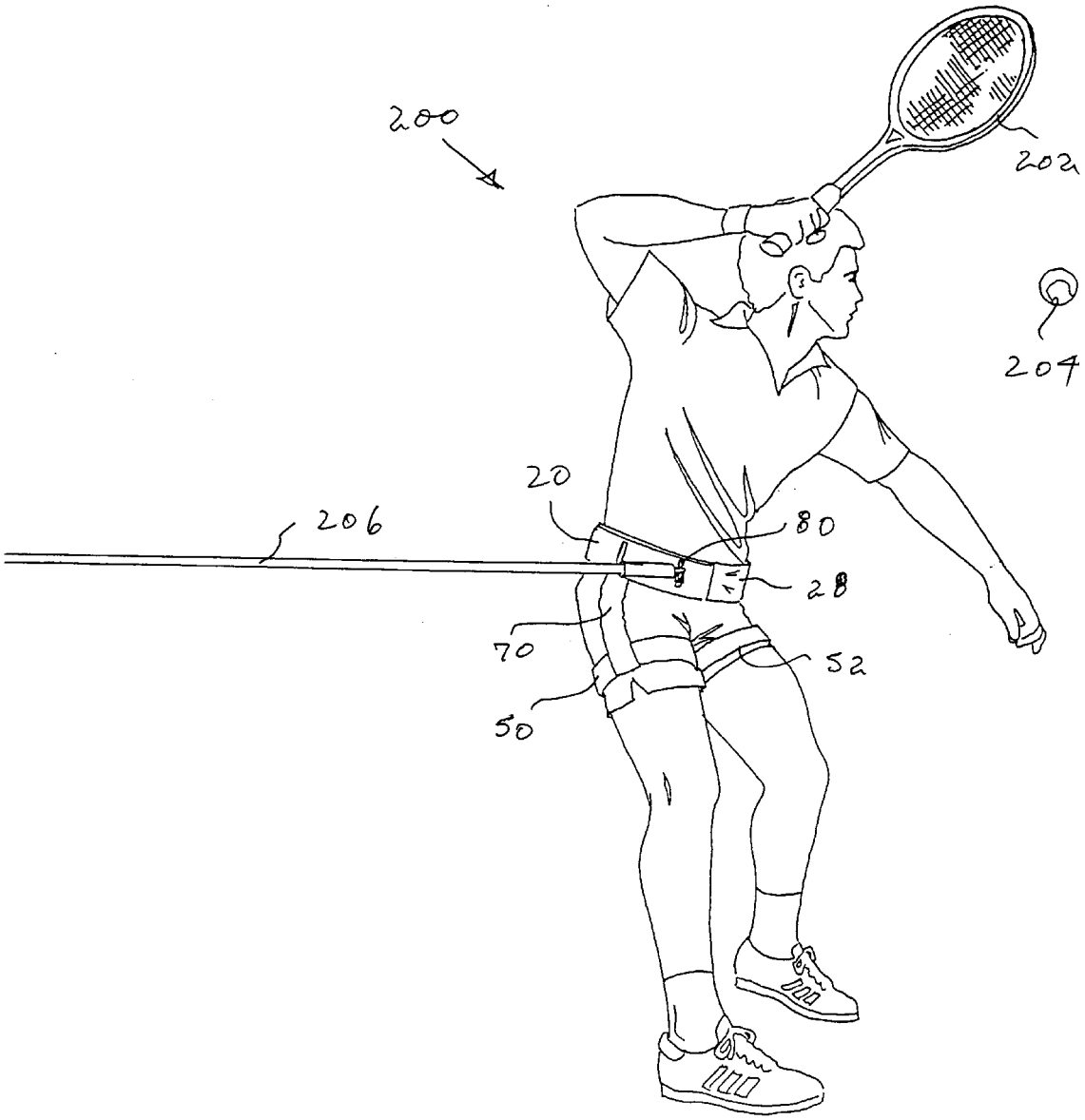
FIG. 11 is a view showing the harness as used in training a user making a tennis swing.

Referring to FIG. 11, a tennis player 200 is shown as swinging a tennis racket 202 to strike a tennis ball 204. A tether 206 similar to those shown before is connected to connector 80 of the waist harness disposed in operative position on the tennis player. Here again, the tether provides resistance to the swinging motion of the player to increase the power of the player as he overcomes the resistance provided by the tether.

Figure 12:
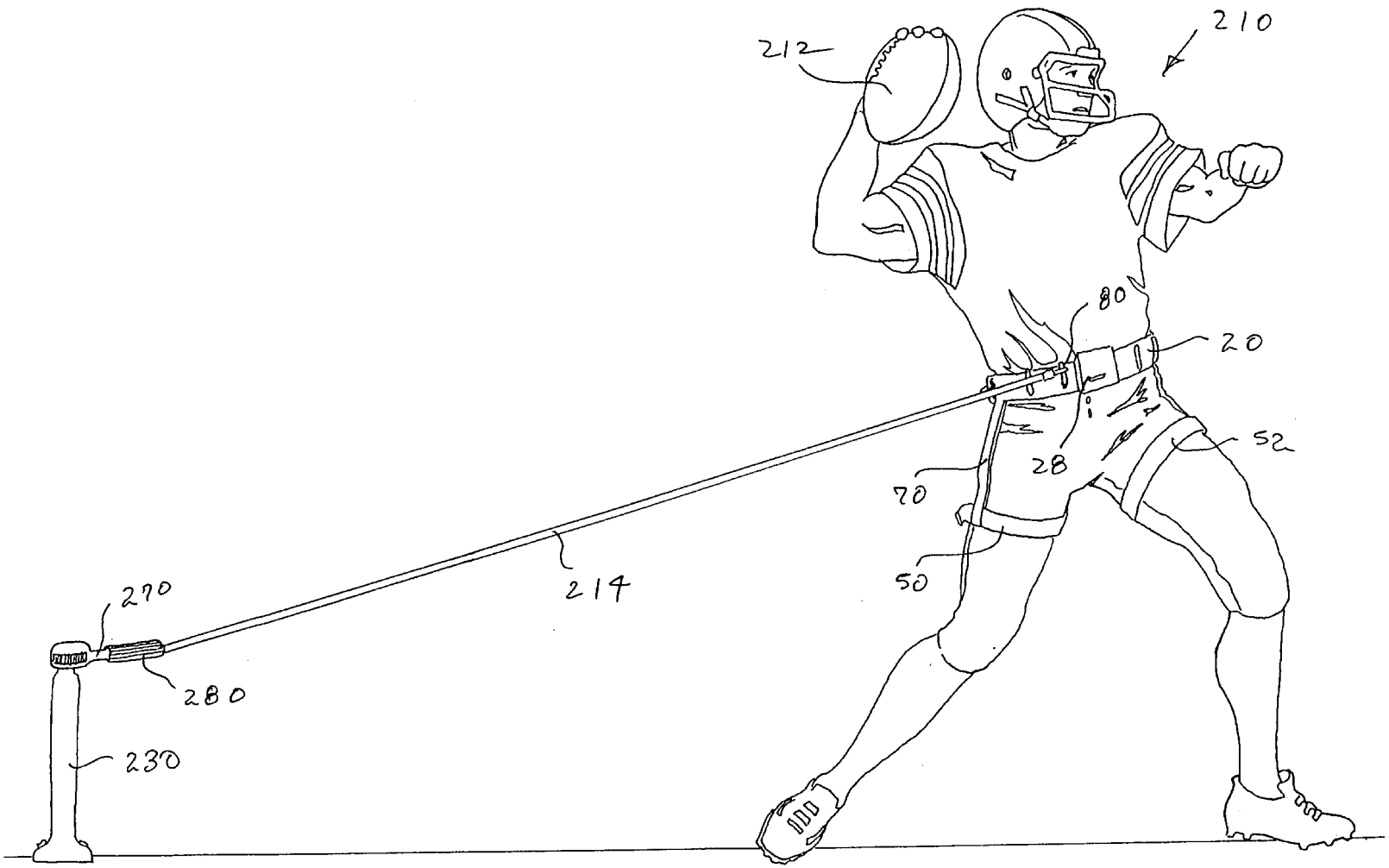
FIG. 12 is a view showing the harness as used in training a user throwing a football.
Figure 13:
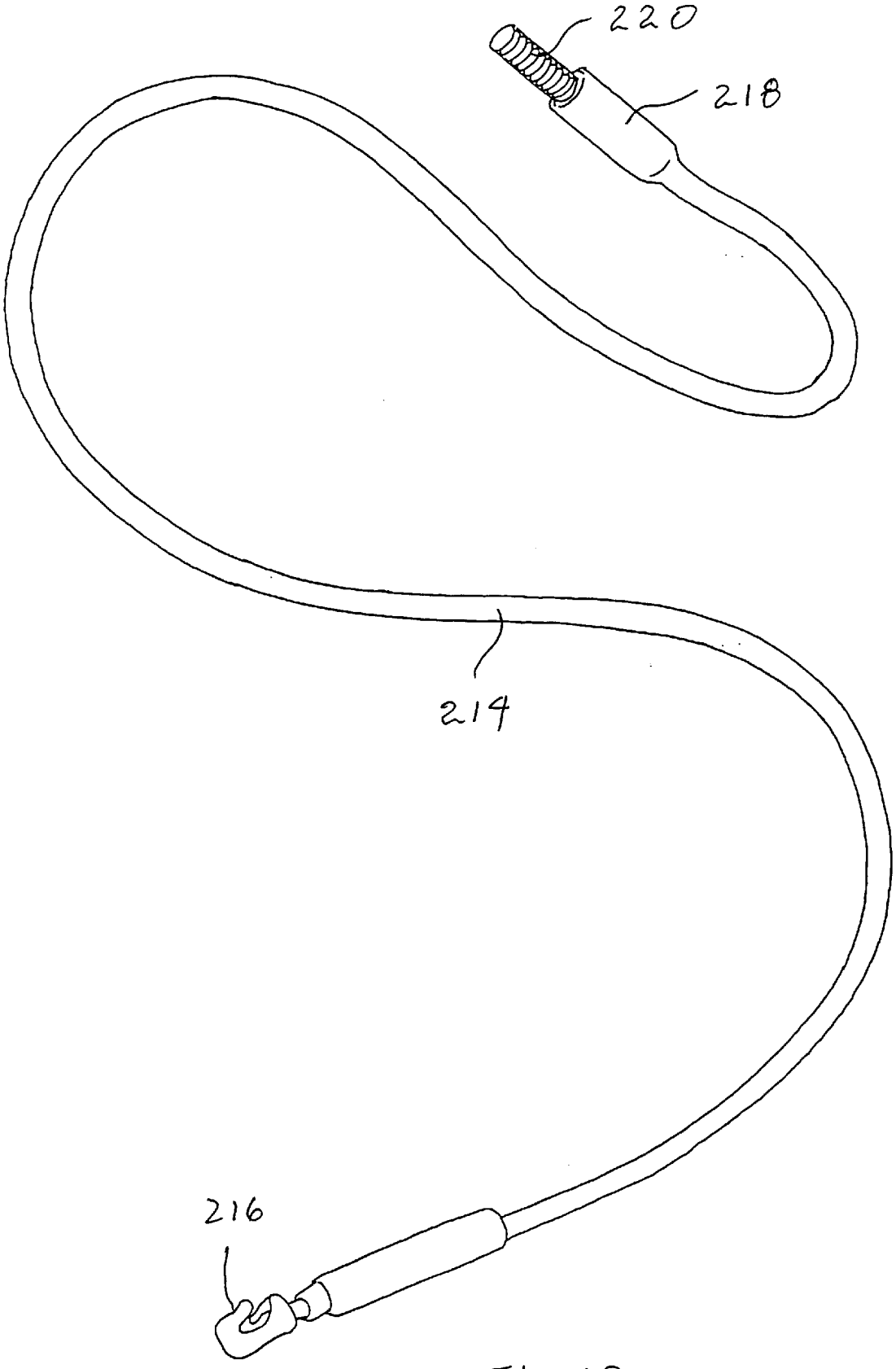
FIG. 13 is a perspective view showing the tether shown in in FIG. 12.

Referring to FIG. 12, a football player 210 is shown as preparing to throw a football 212. A tether 214 is connected to connector 80 on the waist harness worn by the player. The tether provides resistance to the throwing action of the player, thereby increasing the strength of the player in throwing a football. As seen in FIG. 13, the tether 214 is provided with a spring clip 216 at one end thereof, while the opposite end of the tether is provided with an enlarged portion 218 from which extends a threaded member 220 which is adapted to be connected to suitable anchoring means.

Figure 14:
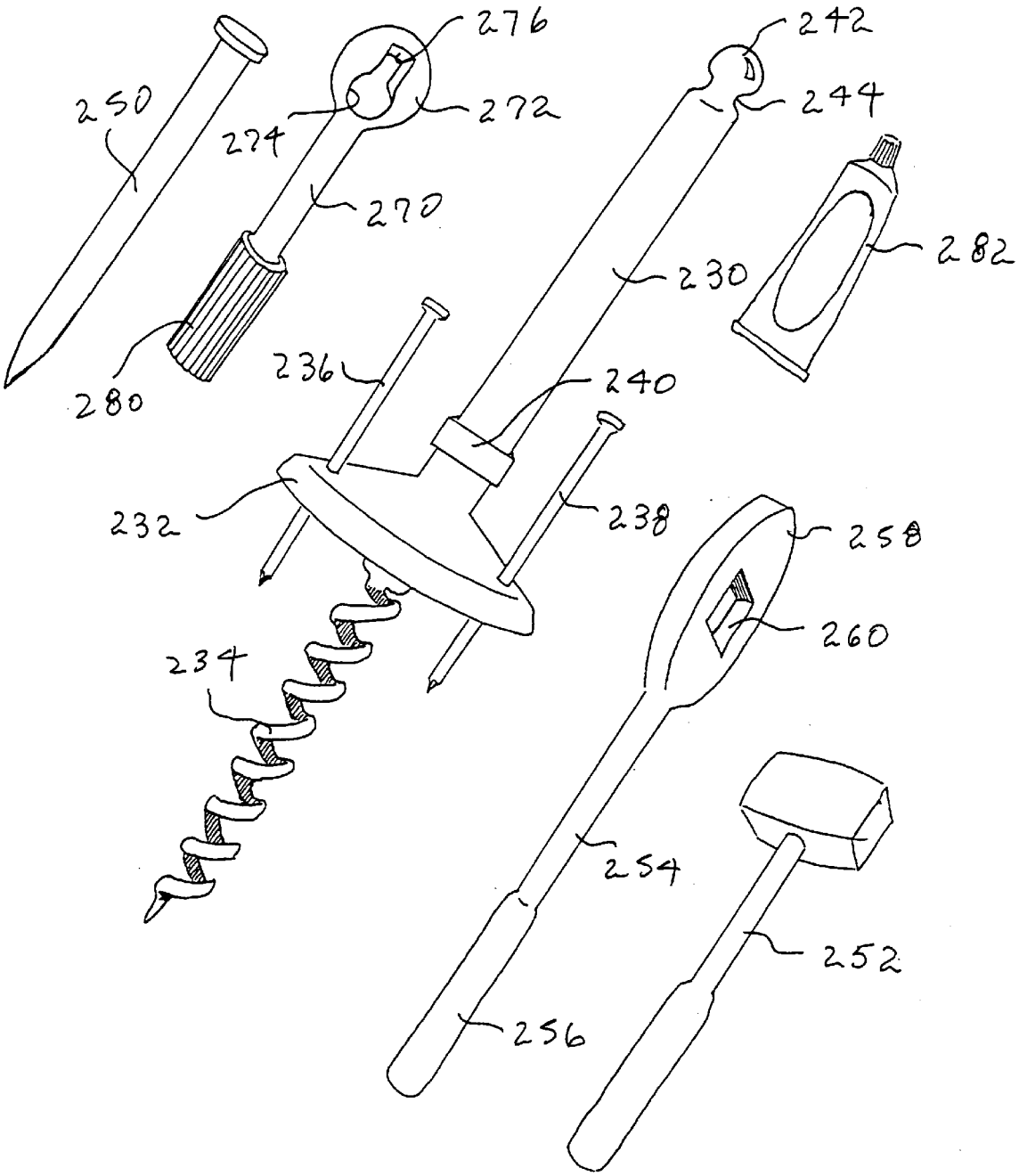
FIG. 14 is an exploded view showing the elements used to anchor the tether shown in FIG. 13.

Referring to FIG. 14, the anchoring means for tether 214 includes a post member 230 having a base 232 adapted to rest on the ground. A helical screw 234 extends downwardly from the undersurface of the base and is adapted to be threaded into the ground by turning the post. A pair of spikes 236 and 238 extend through suitable holes provided in the base for securing the base in place after the helical screw has been threaded into the ground. An enlarged portion 240 is provided on the post and has a square outer configuration. The upper end 242 of the post has a spherical configuration and a neck portion 244 of smaller diameter.

A stake 250 is provided which can be driven into the ground by a mallet 252 to form an initial hole into which the helical screw can be threaded to secure the post in position. The post is turned to thread the helical screw into the ground by using a wrench 254 having a handle portion 256 and an enlarged opposite end 258 having a square shaped hole formed therethrough which is adapted to receive the square shaped portion 240 on the post. The spikes 236 and 238 are then driven into the ground by mallet 252 to secure the post in position.

A swivel member 270 has an enlarged end portion 272 having a bayonet slot formed therethrough including a circular portion 274 adapted to pass over spherical end 242 of the post and a reduced rectangular portion 276 which is adapted to receive the neck portion 244 of the post. Swivel member 270 has an internally threaded cylindrical end 280 which is adapted have the threaded member 220 at the end of tether 214 threaded thereinto. It is apparent that when the swivel member is mounted on the top of the post, it can swivel thereabout, while the bayonet slot will ensure that the swivel member does not escape from the top end of the post. A tube of a lubricating substance 282 is provided for lubricating the surfaces at the top of the post and the bayonet slot in swivel member 270 to facilitate swiveling movement of the swivel member.

The drawings specifically illustrate the manner in which a tether can be connected to either connector 80 or connector 82 of the waist harness. However, a tether can also be connected to other connectors on the waist harness, and more than one tether can be used simultaneously. For example, in sports such as tennis or boxing, tethers can be simultaneously connected to connectors 80 and 82 at both sides of the body of a user. Connectors 90 and 92 may be connected to a tether when doing vertical jumping. When taking jump shots with a basketball, tethers can be connected simultaneously to connectors 80, 82, 90 and 92. When training for the long jump, tethers can be simultaneously connected to connectors 102 and 104. A tether can be connected to connector 110 when running.

The shoulder harness may be used in combination with the waist harness, for example, when running or when taking jump shots with a basketball, the shoulder harness being connected to connectors on the waist harness as discussed previously.

The invention has been described with reference to a preferred embodiment. Obviously, various modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. An athletic training harness comprising a waist harness having a waist portion fitting around the waist of a user and including opposite free ends, securing means for securing said free ends to one another, a pair of thigh portions for attachment around the thighs of a user, said thigh portions being supported from said waist portion, and a plurality of connectors each of which is adapted to be connected to a tether, said connectors being supported by said waist portion, and being disposed in spaced relationship along said waist portion, said connectors including a first pair of connectors disposed at locations along the waist portion adjacent the right and left anterior superior iliac spines of a user when the harness is in use.

2. A harness as defined in claim 1 wherein said connectors also include a pair of connectors disposed at locations along the waist portion adjacent the right and left iliac crests of a user when the harness is in use.

3. A harness as defined in claim 1 wherein said connectors also include a pair of connectors disposed at locations along the waist portion adjacent the right and left posterior superior iliac spines of a user when the harness is in use.

4. A harness as defined in claim 1 wherein said connectors also include a connector disposed at a location along the the waist portion adjacent the sacrum of a user when the harness is in use.

5. A harness as defined in claim 1 wherein said thigh portions are adjustable to accommodate users of different size.

6. A harness as defined in claim 1 wherein said waist portion comprises a belt and said thigh portions comprise straps, said straps being supported from said belt by a plurality of spaced support straps, a first support member being fixed to one of said thigh straps, a second support member being slidably connected to said one of said thigh straps, a third support member being fixed to the other of said thigh straps, and a fourth support member being slidably connected to the other of said thigh straps.

7. A harness as defined in claim 1 including a shoulder harness comprising a pair of shoulder straps, a torso strap connected between said shoulder straps, and a plurality of depending connector members connected to said connectors supported by said waist portion.

8. A harness as defined in claim 7 wherein said plurality of connectors also include a pair of connectors disposed at locations along the waist portion adjacent the right and left posterior superior iliac spines of a user when in use, said depending connector members being connected to said connectors disposed at locations along the waist portion adjacent the left and right anterior superior iliac spines and the right and left posterior superior iliac spines of a user when the harness is in use.

9. An athletic training harness comprising a waist harness having a waist portion for attachment around the waist of a user and including opposite free ends, securing means for securing said free ends to one another, a pair of attaching-means disposed at said opposite ends and having means for permitting the pair of attaching means to be connected to a tether, a pair of thigh portions for attachment around the thighs of a user, said thigh portions being supported from said waist portion, and a plurality of connectors each of which is adapted to be connected to a tether, said connectors being supported by said waist portion and being disposed in spaced relationship from one another along the length of said waist portion.

10. A harness as defined in claim 9 wherein said means for permitting the pair of attaching means to be connected to a tether comprises an opening formed through each of said attaching means.

11. A harness as defined in claim 10 wherein each attaching means includes a loop of flexible fabric material, and reinforcing means connected between spaced portions of said loop to reinforce the attaching means.

12. A harness as defined in claim 9 wherein said connectors include a pair of connectors disposed at locations along the waist portion adjacent the right and left anterior superior iliac spines of a user when in use, and a further pair of connectors disposed at locations along the waist portion adjacent the left and right posterior superior iliac spines of a user when the harness is in use.

13. A harness as defined in claim 12 including a shoulder harness having a pair of shoulder straps, a torso strap connected between said shoulder straps, and a plurality of depending connector members, said depending connector members being connected to said connectors disposed at locations along the waist portion adjacent the right and left anterior superior iliac spines and the right and left posterior superior iliac spines of a user when the harness is in use.

14. A harness as defined in claim 9 wherein said connectors include a pair of connectors disposed at locations along the waist portion adjacent the right and left iliac crests of a user when the harness is in use.

15. A harness as defined in claim 9 wherein said connectors include a connector disposed at a location along the the waist portion adjacent the sacrum of a user when the harness is in use.

16. A harness as defined in claim 9 wherein said thigh portions are adjustable to accommodate users of different size.

17. A harness as defined in claim 9 wherein said waist portion comprises a belt and said thigh portions comprise straps, said straps being supported from said belt by a plurality of spaced support members, a first support member being fixed to one of said thigh straps, a second support member being slidably connected to said one of said thigh straps, a third support member being fixed to the other of said thigh straps, and a fourth support member being slidably connected to the other of said thigh straps.

18. A harness as defined in claim 9 including a shoulder harness comprising a pair of shoulder straps, a torso strap connected between said shoulder straps, and a plurality of depending connector members connected to said connectors supported by said waist portion.

* * * * *